US007565091B2

(12) United States Patent
Jao et al.

(10) Patent No.: US 7,565,091 B2
(45) Date of Patent: Jul. 21, 2009

(54) ELECTROPHOTOGRAPHIC APPARATUS

(75) Inventors: Shyh-Hua E. Jao, Pittsford, NY (US); Jiann-Hsing Chen, Fairport, NY (US); James D. Shifley, Spencerport, NY (US); Muhammed Aslam, Rochester, NY (US); Joseph A. Pavlisko, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 250 days.

(21) Appl. No.: 11/746,089

(22) Filed: May 9, 2007

(65) Prior Publication Data

US 2008/0279582 A1 Nov. 13, 2008

(51) Int. Cl.
*G03G 15/11* (2006.01)
*A46B 11/08* (2006.01)

(52) U.S. Cl. ..... 399/109; 399/327; 15/256.51; 428/421

(58) Field of Classification Search ..... 399/109, 399/325–328; 15/256.51; 29/895.1, 895; 492/53; 428/421–422
See application file for complete search history.

(56) References Cited

U.S. PATENT DOCUMENTS 5,978,640 A 11/1999 Segawa
5,998,034 A * 12/1999 Marvil et al. ..... 428/422
6,372,833 B1 * 4/2002 Chen et al. ..... 524/409
6,596,357 B1 * 7/2003 Marvil et al. ..... 428/36.91
2005/0015987 A1 1/2005 Berg

OTHER PUBLICATIONS

Co-pending U.S. Appl. No. 11/472,918, Chen et al., Fuser Member (D-92447).
Co-pending U.S. Appl. No. 11/472,771, Chen et al., Fuser Member (D-92448).
Co-pending U.S. Appl. No. 11/472,888, Chen et al., Fuser Member (D-92449).
Co-pending U.S. Appl. No. 11/472,919, Chen et al., Method of Making Fuser Member (D-92452).
Co-pending U.S. Appl. No. 11/746,083, Jao et al., In-Line Method to Refurbish Fuser Members (D-93411).

* cited by examiner

*Primary Examiner*—Ali Alavi
(74) *Attorney, Agent, or Firm*—Carl F. Ruoff

(57) ABSTRACT

The present invention is an apparatus for refurbishing a fusing member. The apparatus includes a fusing member that contacts the toner image on a receiver medium and fuses the toner image to the receiver medium. The fusing member has an outer contact surface of a fluorothermoplastic resin The apparatus includes a tooling member positionable adjacent to the outer contact surface of the fusing member such that a pressure nip is formed between the outer contact surface of the fusing member and the tooling member. A heat source is provided for transferring heat to the fusing member and the tooling member, wherein the surface of the fuser member is engagable with the tooling member to rotate at a speed of at least 1 rpm at a pressure of at least 5 psi and at a temperature of at least 10° C. below the thermoplastic melting temperature of the outer contact surface for a time sufficient to resurface of the outer surface of the fuser member.

2 Claims, 1 Drawing Sheet

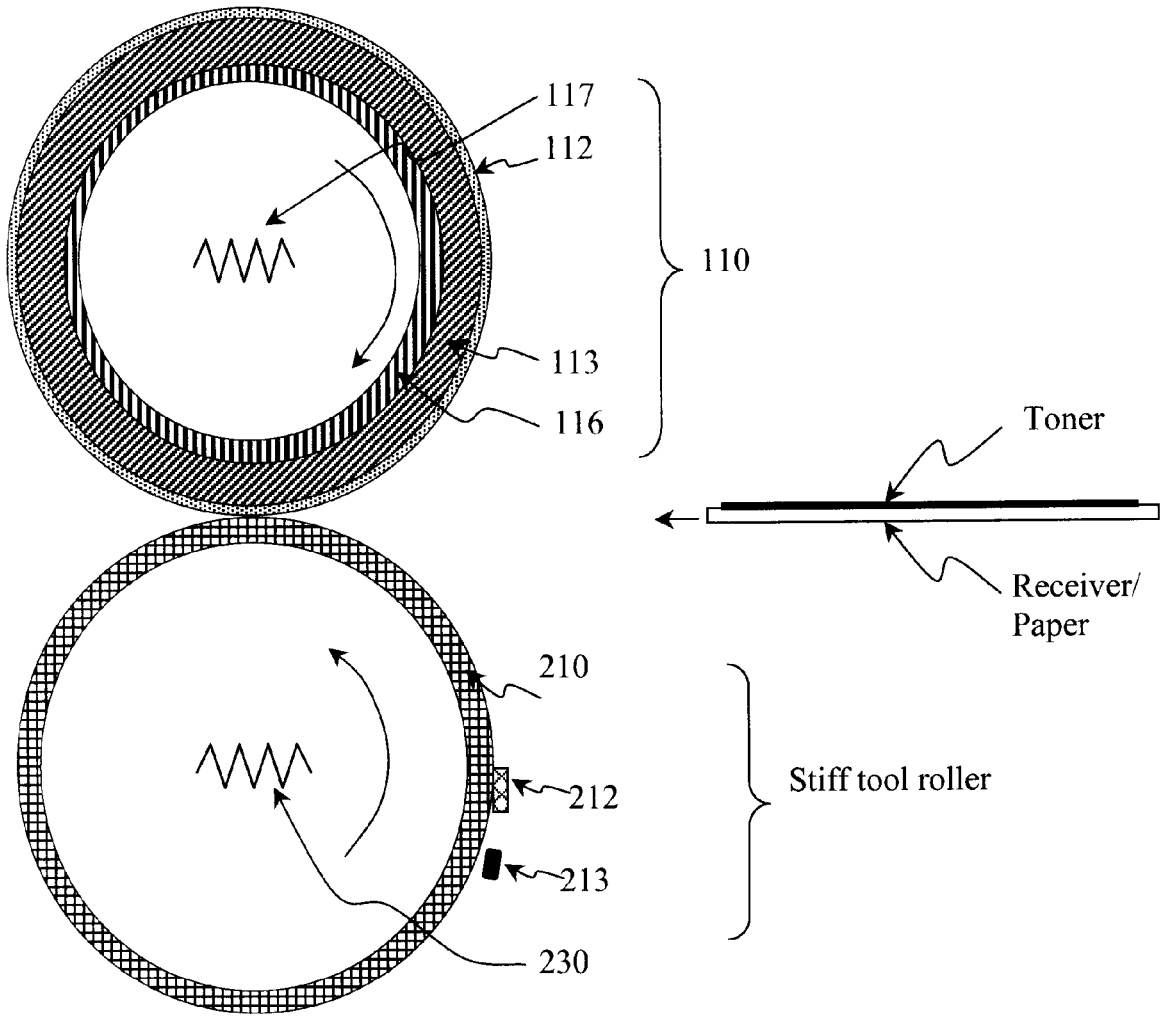
117
112
110
113
116
Toner
Receiver/
Paper
210
212
213
230
Stiff tool roller

ELECTROPHOTOGRAPHIC APPARATUS

CROSS-REFERENCE TO RELATED APPLICATIONS

This application relates to commonly assigned, copending application U.S. application Ser. No. 11/746,083 "IN-LINE METHOD TO REFURBISH FUSER MEMBERS" filed simultaneously herewith.

FIELD OF THE INVENTION

This invention relates to electrostatographic apparatus and fuser members and in particular to a fuser roller or member which includes an outermost fluoropolymer resin layer that can be refurbished during routine maintenance without removal from the electrostatographic apparatus.

BACKGROUND OF THE INVENTION

The surface (or the topcoat) for fuser members in oil-less fusing requires ultra low surface energy to release the substrate. An improved topcoat material oil-less fusing is high-temperature tolerant thermoplastic, such as, FEP, PFA or PTFE, described in U.S. Ser. Nos. 11/472,918, 11/472,771, 11/472,888 and 11/472,919.

However, during fuser printing performance tests paper edges, particularly of thick paper, can occasionally leave wear marks on the topcoat of the fuser surface. These paper edge marks can show up as gloss-variation artifact when subsequent prints are made on a wider paper of a full page image. Moreover, for printing special images, particularly one with in-track stripes of area of no toners, foreign materials from the paper are seen to periodically accumulate on the surface of the topcoat due to the absence of toners, leading to artifact of gloss variation band artifact when printing a different image next, such as a full page image. Typically, when such image defects occur, the fuser member or members are replaced.

The present invention provides an apparatus for refurbishing in-situ the fuser member, which applied in an internally heated fusing system, i.e., no apparatus external to the fuser member that can provide the function of the invention filed herein.

SUMMARY OF THE INVENTION

The present invention is an apparatus for refurbishing a fusing member. The apparatus includes a fusing member that contacts the toner image on a receiver medium and fuses the toner image to the receiver medium. The fusing member has an outer contact surface of a fluorothermoplastic resin The apparatus includes a tooling member positionable adjacent to the outer contact surface of the fusing member such that a pressure nip is formed between the outer contact surface of the fusing member and the tooling member. A heat source is provided for transferring heat to the fusing member and the tooling member, wherein the surface of the fuser member is engagable with the tooling member to rotate at a speed of at least 1 rpm at a pressure of at least 5 psi and at a temperature of at least 10° C. below the thermoplastic melting temperature of the outer contact surface for a time sufficient to resurface of the outer surface of the fuser member.

BRIEF DESCRIPTION OF THE DRAWINGS

FIG. 1 is a cross-sectional view of a fuser member suitable for refurbishing in accordance with the present invention.

For a better understanding of the present invention together with other advantages and capabilities thereof, reference is made to the following description and appended claims in connection with the preceding drawings.

DETAILED DESCRIPTION OF THE INVENTION

The present invention can be applied to refurbishing fuser members with thermoplastic topcoat materials. The fluoropolymer resin outer layer includes a fluoropolymer material, such as a semicrystalline fluoropolymer or a semicrystalline fluoropolymer composite. Such materials include polytetrafluoroethylene (PTFE), polyperfluoroalkoxy-tetrafluoroethylene (PFA), polyfluorinated ethylene-propylene (FEP), poly(ethylenetetrafluoroethylene), polyvinylfluoride, polyvinylidene fluoride, poly(ethylene-chloro-trifluoroethylene), polychlorotrifluoroethylene and mixtures of fluoropolymer resins. Some of these fluoropolymer resins are commercially available from DuPont as Teflon™ or Silverstone™ materials.

The instant invention is not dependent on how the fuser member is manufactured, i.e., not affected by whether the topcoat is sleeve molded, sintered with dispersion, sprayed or transfer-coated, etc. The apparatus of the present invention will be used in combination with the copending application U.S. application Ser. No. 11/746,083 "IN-LINE METHOD TO REFURBISH FUSER MEMBERS" to increase the usable life of the fuser member owing to its ability to restore a uniform gloss surface finish of the fuser member in its intended robustness of printing applications across different substrate types.

In all embodiments, fuser members are preferably cylindrically symmetrical, i.e., a cross-section of the roller taken at a right angle to the roller axis anywhere along the length of the member or roller has radial symmetry around the roller axis. The length of the roller thereof determines the range of the printing width of the substrate.

FIG. 1 shows a cross-sectional view of a fuser member 110, according suitable for use in the present invention. The generally concentric central core 116 for supporting the plurality of the layers is usually metallic, such as stainless steel, steel, aluminum, etc. The primary requisite for the support 116 materials are that it provides the necessary stiffness, being able to support the force placed upon it and to withstand a much higher temperature than the surface of the roller where there is an internal heating source. Various layers can be deposited above the support 116 such is a resilient layer, also termed a cushion layer, tie layers, adhesion promotion layers, and primer layers for bonding the cushion layer (shown schematically as 113) with the outmost layer 112. The outermost layer 112, is a toner release layer, which includes a thermoplastic fluoropolymer such as PTFE, PFA, and FEP, etc. and blends thereof. The fuser member shown in FIG. 1 contains an internal heater 117.

The fuser member can be a pressure or fuser plate, pressure or fuser roller, a fuser belt or any other member on which a release coating is desirable. In FIG. 1, a roller is shown. The support for the fuser member can be a metal element with or without additional layers adhered to the metal element. The metal element can take the shape of a cylindrical core, plate or belt. The metal element can be made of, for example, aluminum, stainless steel or nickel. The surface of the metal element can be rough, but it is not necessary for the surface of the metal element to be rough to achieve good adhesion between the metal element and the layer attached to the metal element. The additional support layers adhered to the metal element consists of layers of materials useful for fuser members, such as, silicone rubbers, and adhesion promoter layer to metal core.

The tool roller 210 is positionable with the fuser roller to create a nip when refurbishing is desired. An internal heating element 230 is shown to provide the heat necessary to raise the temperature of the surface of the tool roller to range around the melting point of the topcoat material of the fuser member. A temperature sensor 212 is shown to monitor the surface temperature of the tool roller during its use. The temperature sensor 212 can be contact or non-contact. A fusible over-temperature sensor 213 is provided to cut off the lamp power should the temperature on the surface of the tooling roller rise above a preset amount typically 350° C. for fuser members of the PTFE or PFA topcoat.

The present invention is a high-temperature tooling member together with a set of specialized programmed schemes to simultaneously heat and pressurize the thermoplastic topcoat fuser member to at least 10° C. below the melting temperature of the outer surface topcoat material, for example, from 280° C. to 320° C. for PFA and PTFE materials. The innovation applies the high-temperature tool member and the scheme after the fuser member has serviced for the same print job for a period of time such that artifact may show up in a subsequent different print job, depending on the printing service requirement. The high-temperature tooling member is preferably of non-stick surface and is able to deliver heat to the fuser member surface at a temperature around the melting point of the fuser member topcoat material, typically 280° C. to 320° C. for PTFE or PFA topcoats. The high-temperature tooling member includes a temperature monitoring sensor and a fusible over-temperature sensor set at a clearance that will shut down the heat source when the temperature is 50° C. above the melting point of the fuser member topcoat, typically, 350° C. for PTFE or PFA topcoats. The high-temperature tooling member in practice can be of stiff materials and of similar design and dimensions as those of the pressure roller, so it can be placed in situ at the printing machine and work with the disclosed fuser member refurbishing scheme. The disclosure also covers any practice that will refurbish the fuser member service off-line from the printing machine using a separate apparatus with such a concept of a high-temperature tool member, either of one roller or multiple rollers, and the disclosed scheme to simultaneously heat and pressurize the thermoplastic topcoat for the fuser member to be successfully refurbished. A set of specialized programmed schemes will automatically control the flow of the following steps at a printing machine, or a separate apparatus said above:

(1) Raise the temperature of the external heating rollers, or the said tooling member to a temperature higher than that for normal printing operation, typically from 30 to 50° C. above the normal operating temperature if such external heater rollers are used in printing;

(2) Adjust the distance between the thermally-fused over-temp sensor and the tooling member or the heater roller to a predetermined value such that the over-temp sensor will be active for temperature above 350° C. in the practical application;

(3) Turn on the cooling air if available on site at a position away from the pressurized nip between the tooling member or the heater roller to prevent overheating of the sublayers and to have fast recovery to the normal printing mode set-points of the fuser member surface temperature.

(4) Rotate the fuser member at a speed of at least 1 rpm, and engage the tooling member or the heater roller with the fuser member surface following program-controlled functions of pressure, temperature and rotational speed for a period of time sufficient to refurbish the fuser member, typically from 1 to 3 minutes.

Before activating the above refurbishing scheme with the high-temperature tooling member or the heater roller, it is necessary to assure clean surfaces of the fuser member and the tool roller heater rollers as well. The fuser member surface should be free of contamination, such as, residual toner or deposit of foreign materials, such as from paper. A method to clean the surfaces of the fuser member as well as the heater rollers if existing to precede the method of the present invention is done by non-invasive methods such as by applying soft rags with solvents. For fuser members of mild contamination of foreign materials, the cleaning can be also automatically done by printing a few papers with toners covering the full paper, i.e., the toner itself is used to take away foreign materials.

EXAMPLE

An example is given on a fuser member made of 25-micron-thick PTFE (of a melting temperature of 315° C.) topcoat, under which is 2 mm silicone rubber. The fuser member serviced for 10,000 A4-equivalent prints of Tabloid sized paper on a Nexpress 2100 printing press with internal heated source and showed in-track scratches and de-glossing along the in-track paper on the topcoat. The subsequent print on a wider coated paper showed a gloss drop in G60 value more than 15 points along the de-glossed edge of the fuser member. The fuser member went through the refurbishing scheme with the tooling member as described in this invention. The fuser member was refurbished at temperature around 305 to 315° C. for about 2 minutes such that the scratch lines and the paper edge de-glossing were not visible on the fuser member and the subsequent print on a wider coated paper showed non-measurable difference in G60 value nor visible artifact over the full page of the print and the scratch line artifact was also eliminated.

The invention has been described in detail with particular reference to certain preferred embodiments thereof, but it will be understood that variations and modifications can be effected within the spirit and scope of the invention.

The invention claimed is:

1. Apparatus for refurbishing a fusing member comprising:

a fusing member which contacts the toner image on a receiver medium and fuses the toner image to the receiver medium, the fusing member comprising an outer contact surface comprising a fluorothermoplastic;

a tooling member positionable adjacent to the outer contact surface of the fusing member such that a pressure nip is formed between the contact surface of the fusing member and the tooling member a heat source for transferring heat to the fusing member and the tooling member, wherein the surface of the fuser member is engagable with the tooling member to rotate at a speed of at least 1 rpm at a pressure of at least 5 psi and at a temperature of at least 10° C. below a thermoplastic melting temperature of the outer contact surface for a time sufficient to resurface of the outer surface of the fuser member.

2. The apparatus of claim 1 wherein the fluorothermoplastic comprises a fluoropolymer resin selected from the group consisting of polytetrafluoroethylene, polyperfluoroalkoxytetrafluoroethylene, polyfluorinated ethylene-propylene, polyvinylfluoride, polyvinylidene fluoride, poly(ethylene-chloro-trifluoroethylene), polychlorotrifluoroethylene and blends thereof.

* * * * *